United States Patent [19]

Terral

[11] 4,146,091

[45] Mar. 27, 1979

[54] APPARATUS FOR INSTALLING AND REMOVING FLOW VALVES

[75] Inventor: Ben D. Terral, Houston, Tex.

[73] Assignee: Camco, Incorporated, Houston, Tex.

[21] Appl. No.: 919,112

[22] Filed: Jun. 26, 1978

[51] Int. Cl.[2] ..... E21B 7/06

[52] U.S. Cl. ..... 166/117.5

[58] Field of Search ..... 166/117.5

[56] References Cited

U.S. PATENT DOCUMENTS

| | | | |
|---|---|---|---|
| 3,353,608 | 11/1967 | Beebe et al. | 166/117.5 |
| 3,788,397 | 1/1974 | Terral et al. | 166/117.5 |
| 3,827,490 | 8/1974 | Moore, Jr. et al. | 166/117.5 |

*Primary Examiner*—James A. Leppink

*Attorney, Agent, or Firm*—Fulbright & Jaworski

[57] ABSTRACT

A well valve handling apparatus or kickover tool for placing a valve in or removing a valve from an offset sidepocket in a mandrel in a well tubing and having a support body, a shifting tool pivotally supported from the support body with spring means yieldably urging the shifting tool towards the sidepocket by acting against a spring base initially positioned to engage one end of the spring. After use, the base is moved out of engagement with the spring for allowing the shifting tool to pivot towards alignment with the support body. A movable body having first and second parts is carried by the support body and a shear pin initially holds the two parts together and the support body includes an opening of a smaller size than the shear pin on one side aligned with the shear pin for aiding the removal of the pin when sheared, and the support body includes an opening for inserting the shear pin on the other side aligned with the shear pin whereby the shear pin may be installed and removed without disassembling the apparatus. The valve handling support is pivotally connected to the shifting tool, and the shifting tool includes a spring-loaded detent between the shifting tool and each of the pivot connections to the support body and valve handling support for allowing greater lateral shifting movement of the valve handling support.

10 Claims, 9 Drawing Figures

APPARATUS FOR INSTALLING AND REMOVING FLOW VALVES

BACKGROUND OF THE INVENTION

Generally, well valve handling apparatus or kickover tools include a spring for laterally moving a shifting tool and valve handling support from the bore of the well tubing into an offset pocket for inserting and/or removing a valve from the offset sidepocket. After use, the kickover tool is retrieved by moving the tool upwardly in the well tubing and the shifting tool is pulled back into the well tubing by overcoming the force of the kickover spring. If the kickover spring continuously urges the shifting tool and valve holding support against the side of the well tubing damage to the shifting tool and valve handling support occurs, as well as damage to any plastic coating in the well tubing. A kickover tool which releases the force of the kickover spring for reducing drag between the tool and the tubing on retrieval is illustrated in U.S. Pat. No. 3,788,397. The present invention is directed to various improvements in a valve handling apparatus or kickover tool in which the force of the kickover spring is released, improvements to provide a greater movement of the shifting tool relative to the support body for allowing greater lateral shifting movement of the valve handling support, and a construction is provided for allowing the ease of installation and removal of a releasing shear pin without disassembling the apparatus.

SUMMARY

The present invention is directed to various improvements in a well valve handling apparatus or kickover tool for use in placing a valve in or removing a valve from an offset pocket in a mandrel in a well tubing and having a support body with a shifting tool pivotally supported from the support body with releasing means for initially holding the shifting tool aligned with the support body, a valve handling support pivotally supported from the shifting tool, and a spring urging the shifting tool towards the sidepocket when the releasing means is released. One feature is the provision of means for releasing the shifting force of the spring from the shifting tool, after use, whereby the shifting tool may become pivotally aligned with the support body during retrieval through the well tubing by providing a spring base initially positioned to engage one end of the spring for moving the shifting tool, but moving the base out of engagement with the spring for allowing the shifting tool to pivot towards alignment with the support body after use. The base may be releasably secured to the support body or the base may be biased in a holding position and is moved out of engagement with the spring by movement of a movable body relative to the support body.

A still further object of the present invention is the provision of an improved valve handling apparatus in which the valve handling support is pivotally connected to the shifting tool, and the shifting tool includes a springloaded detent between the shifting tool and each of the pivot connections to the support body and the valve handling support for allowing greater lateral shifting movement of the valve handling support towards the sidepocket which is particularly desirable in larger size mandrels. The springloaded detents, while allowing the valve handling support to be moved a greater distance laterally and allow alignment with the valve pocket, also act to realign the shifting tool and valve handling support with the support body after use.

Yet a still further object of the present invention is the provision of a kickover tool having a movable body with first and second parts and a shear pin initially holding the two parts together. The support body includes an opening of a smaller size than the shear pin on one side and aligned with the shear pin which acts as a stop and sight hole for one end of the shear pin, and also aids in removing the pin when sheared. The support body includes an opening for inserting the shear pin on the other side aligned with the shear pin whereby the shear pin may be installed and removed without disassembling the apparatus.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the present invention will be described in connection with a valve handling apparatus or kickover tool similar to that described in U.S. Pat. No. 3,788,397 or 3,827,490, it is understood that the present invention may be used with other types of kickover tools.

Figure 1A:
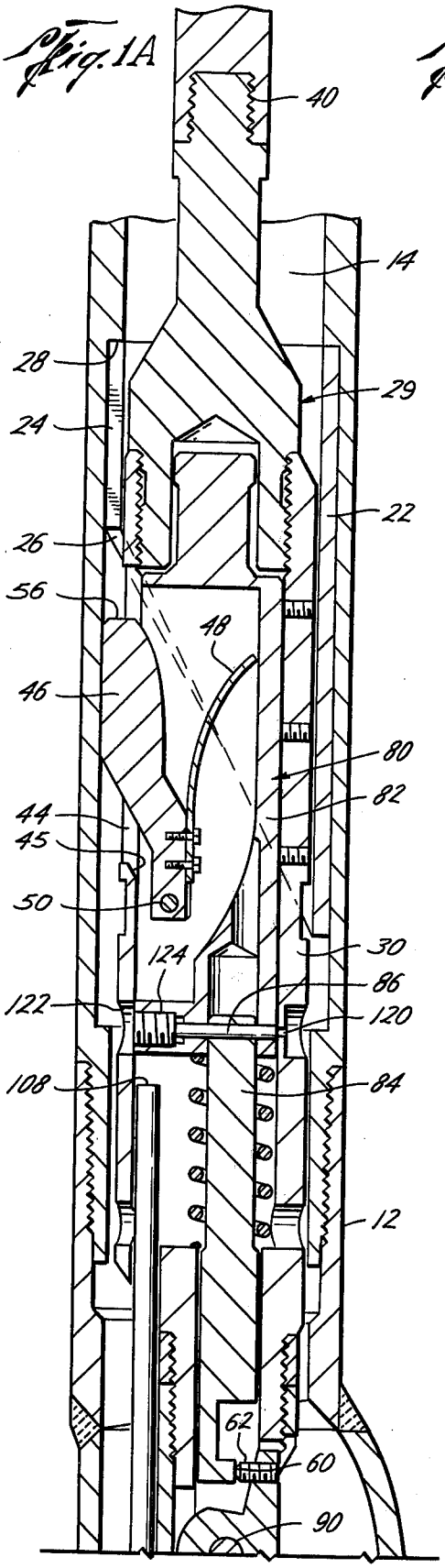
FIG. 1A is an elevational view, in cross section, showing the top portion of the present invention in the running in position in a well mandrel.
Figure 1B:
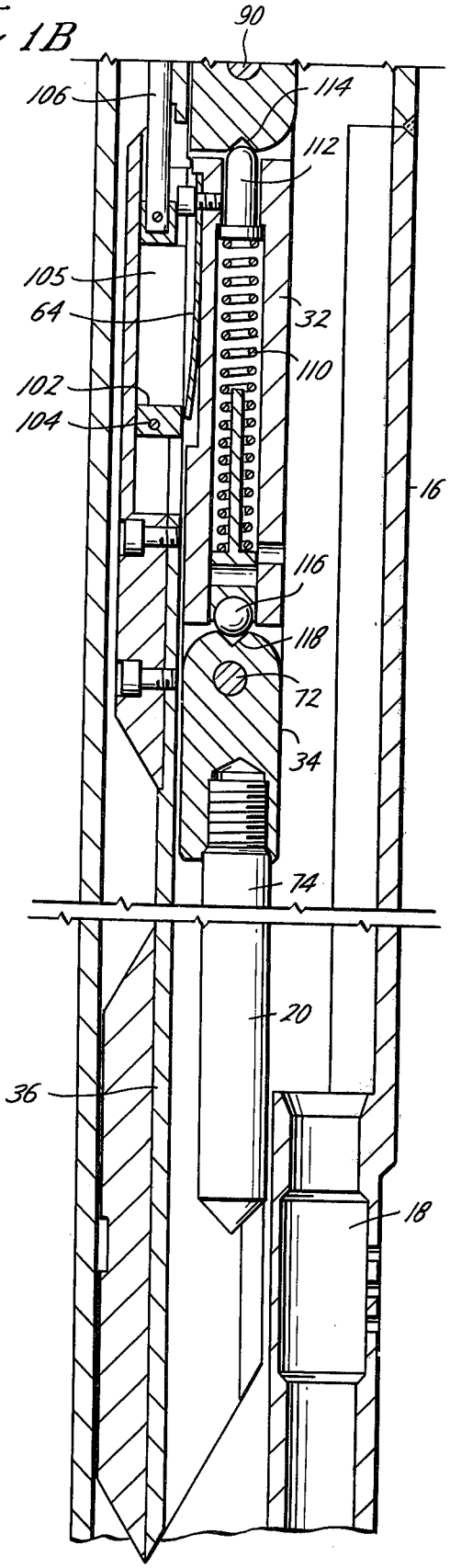
FIG. 1B is a continuation of FIG. 1A.

Referring now to the drawings, and particularly to FIGS. 1A and 1B, a well tubing (not shown) may have connected therein a plurality of vertically spaced mandrels 12, where shown as only one for convenience. Each tubing mandrel 12 includes a main bore 14 therethrough generally having the same size and aligned with the bore of the well tubing, and further includes a sidepocket 16 whose axis is offset from the main bore 14 and includes a valve seat 18 for receiving a flow control valve 20 therein. The present invention is directed to a valve handling apparatus or kickover tool generally indicated by the reference numeral 29 for movement in the tubing and mandrel 12 for installing or removing a valve 20 in or from the seat 18 in the mandrel 12.

Figure 2A:
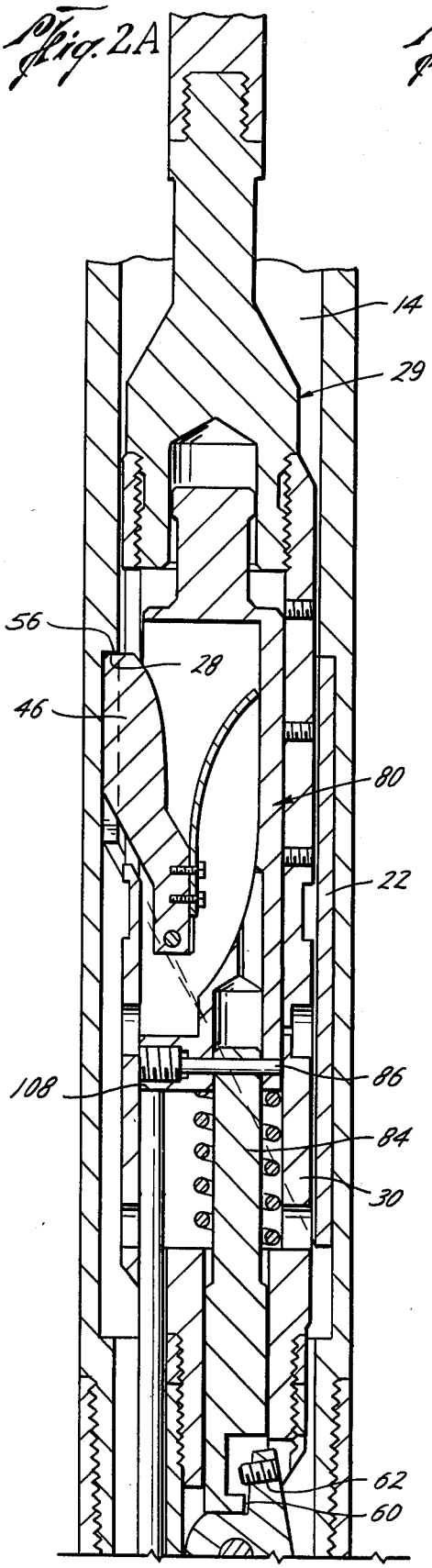
FIG. 2A is a view similar to FIG. 1A but showing the apparatus of the present invention in the shifted or kicked over position.
Figure 3A:
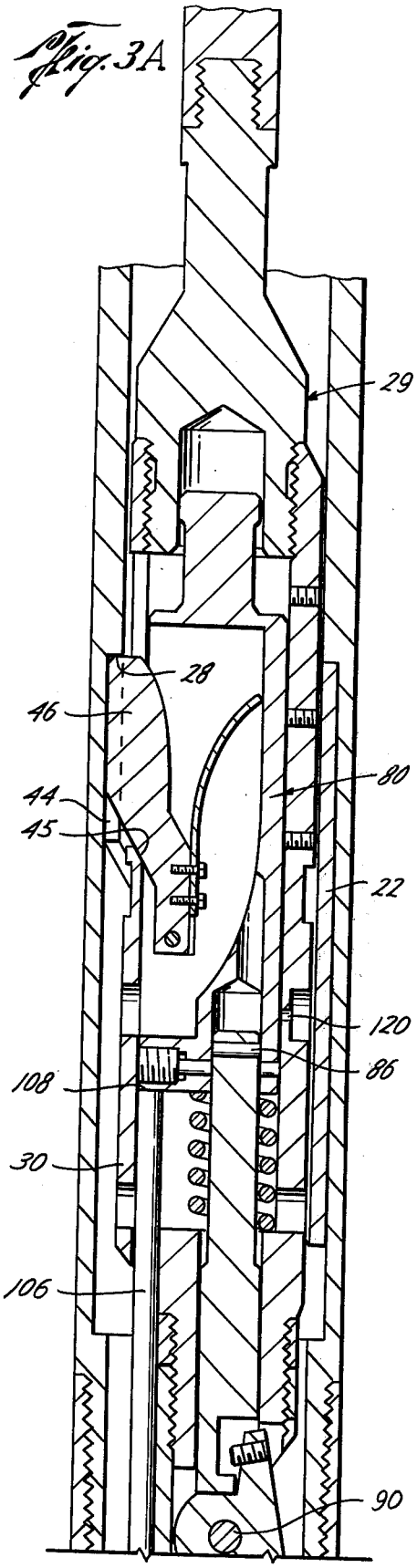
FIG. 3A is a view similar to FIG. 1A but shows the apparatus of the present invention in the process of being removed from the well tubing after use.

Referring to FIGS. 1A, 2A and 3A, a guide sleeve 22 may be provided aligned with the main bore 14 and includes a longitudinal guide slot 24, a guide surface 26 positioned below and directed upwardly towards the bottom of the slot 24 for guiding a key upwardly and into the slot 24, and an actuating shoulder 28 positioned at the top of the slot whereby the valve handling apparatus 29 may be rotated and oriented relative to the valve pocket 18 and actuated for installing or removing a valve therefrom.

The valve handling apparatus or kickover tool 29 generally includes a support body generally indicated by the reference numeral 30, a shifting tool or arm 32 which is pivotally supported from the support body 30 by pivot pin 90, a valve handling support 34 which is pivotally carried by the shifting tool 32 from a pivot pin 72, and an elongate guide case 36 connected to body 30, and a longitudinally movable body 80 carried by the support body 30. The support body 30 includes any suitable means for moving the apparatus 29 through the tubing and mandrels 12 such as a hydraulic locomotive, or as shown, for example only, a connection 40 for attachment to a wireline. The movable body 80 generally includes a first part 82 and a second part 84 which are intially secured together by a shear pin 86.

A guide key 46 is pivotally connected to the movable body 80, such at its lower end by an emergency shear pin 50. Support body 30 includes an opening 44 through which the guide key 46 is yieldably urged outwardly by a spring 48. The guide key 46 includes an upwardly directed actuating shoulder 56, which when the key 46 is below the guide surface 26, will contact the surface 26 thereby rotating and aligning the valve handling apparatus 29 in the bore 14 as the key 46 moves along the guide surface 26, into the slot 24, and into engagement with the actuating shoulder 28.

Figure 2B:
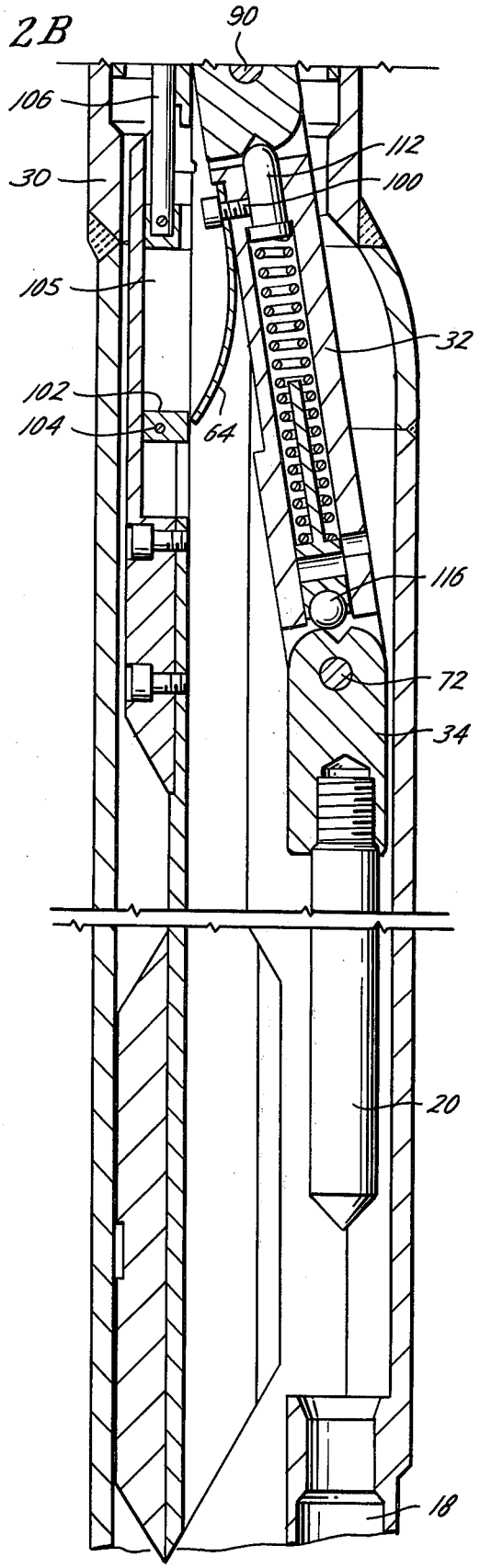
FIG. 2B is a continuation of FIG. 2A.

Suitable releasable engaging means such as shoulder 60 is connected to the lower end of the second part 84 of the movable body 80 for engaging a portion of the shifting tool 32, such as pin 62, to keep the tool 32 initially aligned with the support body 30 and within the guide case 36 and thus aligned with the main bore 14 as the apparatus 29 is initially moved down the well bore. However, when the apparatus 29 is moved into the mandrel in which it is desired to install or remove a valve, the apparatus 29 is raised and the guide key 46 moves along the guide surface 26 orienting the apparatus 29, and into the guide slot 24 until the shoulder 56 engages the actuating shoulder 28 which prevents further upward movement of the movable body 80 but allows further upward movement of the support body 30. This will disengage the releasable engaging means as the pin 62 moves upwardly past the shoulder 60 allowing the shifting tool 32 to be actuated and rotated about pivot pin 90 and shifted towards the sidepocket 16 as the spring 64 acts between the support body 30 and the support tool 32 to shift shifting tool 32 and the valve handling support 34 over towards the sidepocket 16 and aligned over the valve seat 18. For installing a flow control valve 20, a suitable running adapter 74 such as the type JC-3 sold by Camco, Incorporated of Houston, Texas, and as more fully described in U.S. Pat. No. 3,353,608 may be used. With the release of the shifting tool 32 and its movement outwardly and above the valve seat 18, as best seen in FIG. 2B, the kickover tool or valve handling apparatus 29 may be lowered to cause the lower end of the valve 20 to move into the valve seat 18. The pivoted connection 72 between the shifting tool 32 and the valve handling support 34 allows the valve 20 to become vertically aligned with the valve seat 18 and further downward movement and jarring of the apparatus 29 allows the valve handling support 34 and adapter 74 to become aligned with the valve seat 18 and further downward movement seats the valve 20 in the valve seat 18. Of course, the valve handling apparatus 29 may also be used to remove a valve 20 from a valve seat in a selected mandrel by utilizing a pulling adapter of any conventional type, such as the type JDC of Camco, Incorporated, as shown in U.S. Pat. No. 3,353,608, in place of the running adapter 74.

After the valve 20 is seated or removed from the valve seat 18, the apparatus 29 is withdrawn by upward movement and the key 46 again enters the slot 24 and engages the actuating shoulder 28. Further upward movement of the apparatus 29 shears the pin 86 allowing the shoulder 45 on the body 30 to engage the key 46 and move it through the window 44 and into the cavity of the movable body 40 so that the apparatus 29 may be withdrawn. The above-named general description of the kickover tool 29 is generally disclosed in U.S. Pat. Nos. 3,788,397 and 3,827,490.

However, assuming that the kickover tool 29 is removed through the tubing while the spring 64 continues to urge the shifting tool 32 outwardly, the shifting tool 32 and valve handling support 34 and any adapters and valves rub against the inside of the tubing causing wear and damage to the kickover tool 29 as well as damaging any plastic coating on the inside of the tubing. The problem is increased in larger size equipment as the spring 64 must be of sufficient strength to shift heavier and larger equipment a greater lateral distance. One of the features of the present invention is an improved means for releasing the force of the spring 64 so that the shifting tool 34 may freely pivot about the pivot 90 by gravity and align itself with the support body 30 and avoid undue dragging against the inside of the tubing as the tool 29 is retrieved.

Figure 3B:
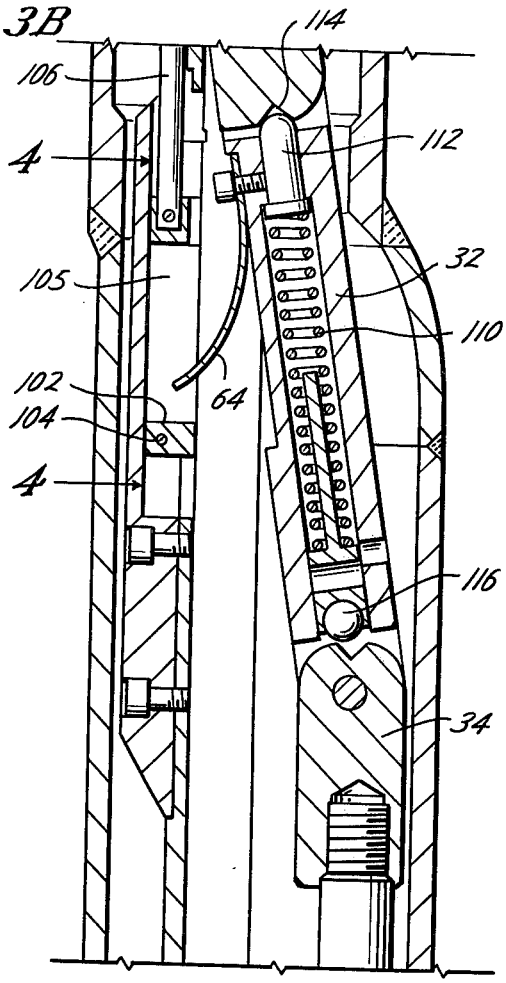
FIG. 3B is a continuation of FIG. 3A.
Figure 4:
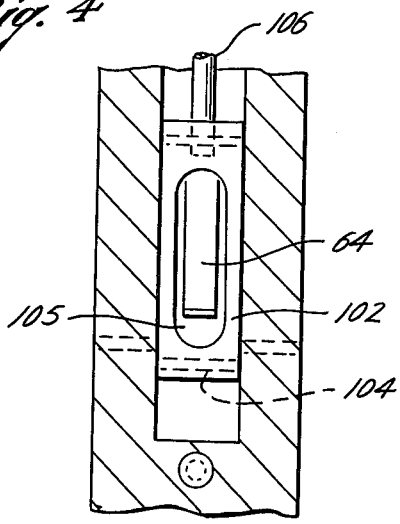
FIG. 4 is a cross-sectional view taken along the line 4—4 of FIG. 3B.

Referring now to FIGS. 1B and 2B, the spring 64 is preferably a leaf spring, one end of which is preferably secured to the shifting tool or arm 32 by a screw 100. The second end of the spring 64 rests against a spring base 102 which is releasably secured to the support body 30 by a shear pin 104 for initially positioning the base 102 at a position against the second end of the spring 64. The base 102 may include a cavity 105 and is connected to a rod 106 which extends to a position where its upper end 108 is adjacent to the movable body 80. The base 102 remains in position throughout the time that the apparatus 29 is used to install or remove a valve 20 from the seat 18. Only after the installation or removal process is completed and the apparatus 29 is ready to be removed from the mandrel 12 is the second end of the spring 64 released from compression and operation. As best seen in FIGS. 3A and 3B when the apparatus has completed its operation the key 46 is again raised to the actuating shoulder 28 and shears the pin 86 and the upward movement of the support body 30 carries the upper end 108 of the rod 106 upwardly into contact with the movable body 80 which is held by the actuating shoulder 28. Therefore, upward movement of the support 30 causes the rod 106 to engage the movable body 80 and shear the pin 104 and pushes the base 102 downwardly relative to the end of the spring 64 to allow the spring 64 to enter into the cavity 105 and release the compressive force in the spring 64. The shifting tool 32 may rotate about the pin 90 from the support body 30 and assume a generally aligned position with the body 30 for retrieval upwardly through the well tubing without being forced outwardly against the inside of the tubing by the spring 64.

Figure 5A:
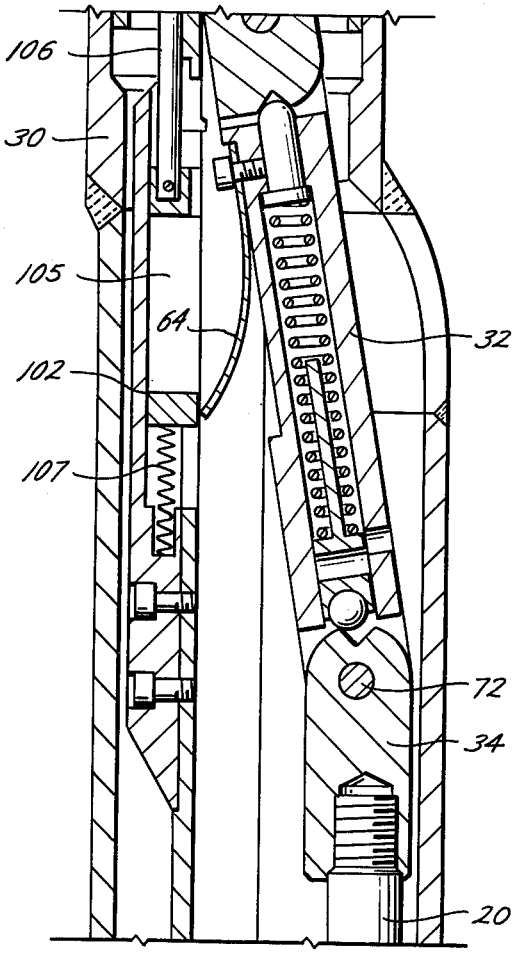
FIG. 5A is a view similar to FIG. 2B, but showing a modified form of an apparatus for engaging and disengaging the kickover spring, here shown in the engaged position.
Figure 5B:
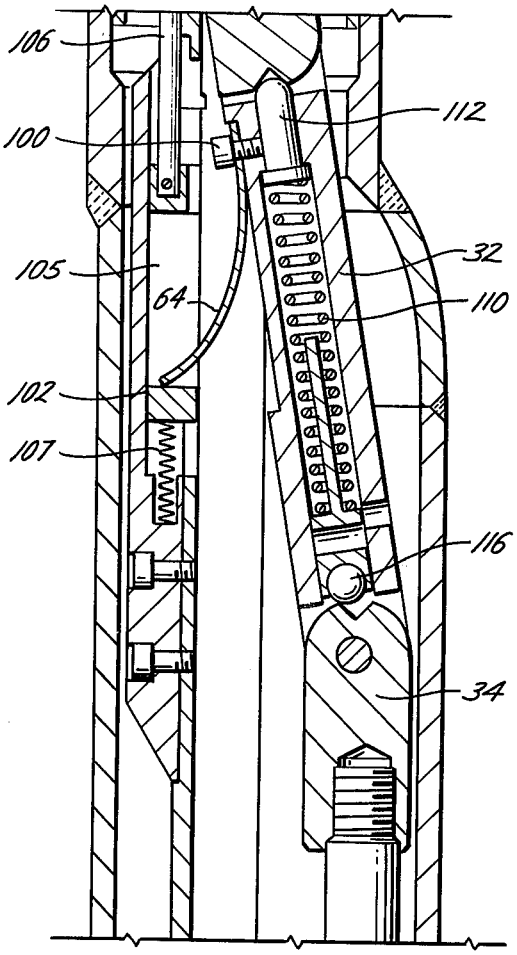
FIG. 5B is a view similar to FIG. 5A, but showing the kickover spring disengaged.

Referring now to FIGS. 5A and 5B, another embodiment is shown for positioning the spring base 102 as shown. In this embodiment, the shear pin 104 of FIGS. 1-3 is omitted and biasing means 107 such as spring is provided to bias the spring base 102 upwardly into engagement with the kickover spring 64, as best seen in FIG. 5A. After the apparatus 29 has completed the installation or removal process, it is actuated in the same manner as previously described causing the rod 106 to push the base 102 downwardly relative to the end of the spring 64 to allow the spring 64 to enter into cavity 105 and release the compressive force in the spring 64 as best seen in FIG. 5B.

Referring now to FIGS. 2A and 2B, when the releasing engagement means 60 and 62 between the body 30 and the shifting tool 32 are released, the shifting tool 32 is laterally moved towards the sidepocket 16 by the spring 64. However, in the larger installations, such as with larger valves, tubings and mandrels, the disengagement of the releasing means 60 and 62 provides only a limited rotation about the pivot pin 90. In order to provide flexibility both in extending the valve handling support 34 outwardly towards the pocket 16 and also in alignment with the vlave seat 18, the shifting tool or arm 32 is provided with a spring-loaded detent between each of the pivot connections 90 and 72. Thus, the tool 32 includes a detent spring 110 which presses a detent 112 against a V-shaped groove 114 near the pivot pin 90. The spring 110 also presses simultaneously against a ball detent 116 against a V-shaped groove 118 adjacent the pivot pin 72 and against the valve handling support 34. Thus, the detents 112 and 116 allow flexing movement between the shifting tool 32 and the support body 30, and in addition allow flexing movement between the shifting tool 32 and the valve handling support 34 whereby the valve handling support 34 may move outwardly and over the valve seat 18 and into alignment with the seat 18 so as to be more freely insertable and removable instead of being moved at an angle to the seat 18. Furthermore, the detents 112 and 116 will serve to realign the shifting mechanism of the tool 32 and its interconnections thereby further preventing wear and tear on the apparatus 29 as it is withdrawn from the well.

Referring to FIGS. 1A and 3A, it is noted that the shear pin 86 is sheared after the use of the apparatus 29 for retrieving the kickover tool from the well. In the prior art kickover tools, the apparatus 29 was required to be disassembled for replacing the sheared pin 86 prior to reusing. Another feature of the present invention is the provision of means for installing a new shear pin 86 or removing a sheared pin 86 without disassembling the apparatus. The support body 30 is provided with an opening 120 of a smaller size than the shear pin 86 on one side of the body 30 and aligned with the shear pin 86. The opening 120 provides a sight hole to determine the proper positioning of the shear pin 86 as well as providing an entrance for a tool for removing broken parts of the pin from the movable body 80. The body 30 also includes on its other side an opening 122 aligned with the shear pin 86 for inserting a new shear pin into the movable body parts 82 and 84 as well as a plug 124 for securing the shear pin 86 in place. Thus, the access openings 120 and 122 allow the shear pin 86 to be repinned without taking the apparatus 29 apart after each use.

The present invention, therefore, is well adapted to carry out the objects and attain the ends and advantages mentioned as well as others inherent therein. While a presently preferred embodiment of the invention is given for the purpose of disclosure, numerous changes in the details of construction, and arrangement of parts, may be made without departing from the spirit of the invention and the scope of the appended claims.

What is claimed is:

1. In a well valve handling apparatus adapted for use in placing a valve in or removing a valve from an offset sidepocket in a well tubing and having a support body, a shifting tool pivotally supported from the support body, releasing means for initially holding the shifting tool aligned with the support body, a valve handling support pivotally supported from the shifting tool, spring means yieldably urging the shifting tool towards the sidepocket when the releasing means is released, the improvement comprising, a spring base initially positioned to engage one end of the spring means for actuating the shifting tool towards the sidepocket, and means for moving said base out of engagement with the spring means for allowing the shifting tool to pivot towards alignment with the support body after use.

2. The apparatus of claim 1 wherein the base is releasably secured to the support body.

3. The apparatus of claim 1 including means for biasing the base into engagement with the spring means.

4. In a well valve handling apparatus adapted for use in placing a valve in or removing a valve from the sidepocket of a well mandrel in which the handling apparatus includes a support body adapted to be moved in said mandrel, a shifting tool pivotally supported from the support body and adapted to support a valve handling support, a movable body carried by the support body, a guide key pivotally secured to the movable body, means yieldably urging said key outwardly from the movable body for engaging a mandrel for orientating and actuating said apparatus, releasing means between said support body and said movable body initially holding the shifting tool aligned with the support body but releasable on upward movement of the support body relative to the movable body when the key engages the mandrel, and spring shifting means connected to the shifting tool for shifting the shifting tool towards the sidepocket when the releasing means is released, the improvement comprising, a spring base initially positioned to engage one end of the spring shifting means for shifting the shifting tool, means for moving said base out of engagement with the spring shifting means for allowing the shifting tool to pivot towards alignment with the support body after a valve has been installed or removed from a sidepocket.

5. The apparatus of claim 4 wherein the base is releasably secured to the support body.

6. The apparatus of claim 5 wherein the means for moving the base includes a member extending between the base and a position adjacent the movable body and is actuated by movement of the movable body relative to the support body.

7. The apparatus of claim 4 includes biasing means for initial biasing the spring base into engagement with the spring means.

8. The apparatus of claim 4 wherein the valve handling support is pivotally connected to the shifting tool, and the shifting tool includes a spring-loaded detent between the shifting tool and each of the pivot connections to the support body.

9. The apparatus of claim 4 wherein the spring-loaded detent includes a spring intermediate each of and acting against both detents.

10. The apparatus of claim 4 wherein the movable body includes first and second parts and a shear pin initially holding the two parts together and said support body includes an opening of a smaller size than the shear pin on one side aligned with said shear pin for aiding in removing the pin when sheared, and the support body includes an opening for inserting said shear pin on the other side aligned with the shear pin whereby the shear pin may be installed and removed without disassembling said apparatus.

* * * * *